US005520016A

United States Patent [19]

Liu

[11] Patent Number: 5,520,016

[45] Date of Patent: May 28, 1996

[54] RING AND CATCH AND METHOD

[75] Inventor: Victor K. C. Liu, Englewood Cliffs, N.J.

[73] Assignee: Atlantis Silverworks, Inc., Daytona, Fla.

[21] Appl. No.: 437,831

[22] Filed: May 9, 1995

[51] Int. Cl.[6] ..... A44C 9/00

[52] U.S. Cl. ..... 63/15; 63/2

[58] Field of Search ..... 63/2, 15, 3, 15.7; 29/160.6; 59/2, 93

[56] References Cited

U.S. PATENT DOCUMENTS

| | | | |
|---|---|---|---|
| 460,103 | 9/1891 | Banghart | 63/15 |
| 921,759 | 5/1909 | Walker | 63/15 |
| 1,043,063 | 11/1912 | Cahoone | 63/2 |
| 1,448,465 | 3/1923 | Sherman | 63/3 |
| 1,510,420 | 9/1924 | Sherman | 63/2 |
| 1,575,161 | 3/1926 | Grode | 63/2 |
| 1,841,375 | 1/1932 | Meyer | 63/2 |
| 2,263,340 | 11/1941 | Kraemer | 63/2 |
| 2,497,207 | 2/1950 | Burk | 63/15.7 |
| 3,091,031 | 5/1963 | Zumbrunnen | 63/2 |
| 5,054,299 | 10/1991 | Maveety | 63/2 |

FOREIGN PATENT DOCUMENTS

| | | | |
|---|---|---|---|
| 236866 | 10/1923 | United Kingdom | 63/3 |

*Primary Examiner*—Flemming Saether
*Attorney, Agent, or Firm*—Richard B. Klar

[57] ABSTRACT

The invention relates to a ring and a method of making the same. The ring has a ring made of PVC material such as FIMO clay and having a hole made, preferably drilled through from one side of the ring head to the other side. A strand of material such as a wire is threaded through the hole. The trailing end of the wire is shaped as a catch and then partially embedded into the side of the ring head. The leading end of the wire is then threaded through beads preferably colored beads whose colors match the designs that are preferably displayed in the faces of the ring head. The leading end is threaded a second time through the hole of the ring head. Any excess material not needed for the ring is then removed by breaking it off or cutting it from the strand. The lead end is then shaped as a catch and at least partially embedded into the opposite side of the ring head.

20 Claims, 3 Drawing Sheets

RING AND CATCH AND METHOD

BACKGROUND OF THE INVENTION

1. Field of the Invention

The present invention relates to articles of costume jewelry and in particular rings for fingers and toes and the method of manufacturing the same. The present invention provides a method of manufacturing a ring having a ring head made of any malleable or pliable and elastic material such as but not limited to Polyvinyl chloride (PVC) material. Examples of PVC material include FIMO clay or any other suitable substitute. The ring head is configured preferably with a design on both faces of the ring head and a pieces of material such as a strand of metal or a wire or other similar material that is used to secure the ring head to the ring and to form a beaded ring with beads there which are threaded onto the wire.

2. The Prior Art

Jewelry and method of fabricating jewelry are known from the prior art.

U.S. Pat. No. 1,412,731 to Wormser a necklace made od strung beads.

U.S. Pat. No. 2,051,591 to Brogan relates to a clasp for string jewelry.

U.S. Pat. No. 4,311,149 to Panicci relates to a Beaded Teething Ring, Closure Latch.

None of these patents disclose a method of making a ring or a ring formed of along a head of FIMO clay or other suitable material with wire going through the ring head and forming notches that are at least partially inserted into said ring head. Nor these inventions disclose such a structure or method of making the same which further includes threading the wire through beads.

SUMMARY OF THE INVENTION

It is therefore a principle object of the invention to make a ring that can securely hold a ring head fabricated of FIMO clay or other suitable plastic polymers.

It is another object of the invention to provide an aesthetically pleasing ring with color coordinated beads decorating the ring loop or wire that match or compliment the ring head.

It is yet another object to provide a ring that has a design on its faces of made from FIMO clay or other pliable, elastic material or PVC material.

It is still another object of the invention to make a ring as described in the above that easy to fabricate and cheap to manufacture.

It is still another object to manufacture a ring in which the wire is threaded through the sides of the ring head.

Other objects will become known from the following drawings and description.

BRIEF DESCRIPTION OF THE DRAWINGS

FIG. 10 A is the same step in the process as FIG. 10 with a differently shaped catch;

DETAILED DESCRIPTION OF THE PREFERRED EMBODIMENT(S)

Referring now to FIGS. 1–14 of the drawings, the present invention is for an article of jewelry such as a ring 1 having a ring head 2 made of a malleable and elastic material such as a plastic polymer such as sold by the Eberhard Faber Company of Germany under the trademark FIMO clay or PROMATE, a PVC material sold by a company in Illinois. The material should reform around the threaded wire or strand.

Figure 1:
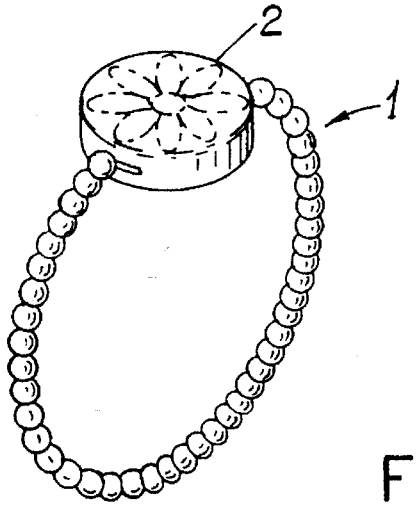
FIG. 1 is a perspective view of the invention.
Figure 2:
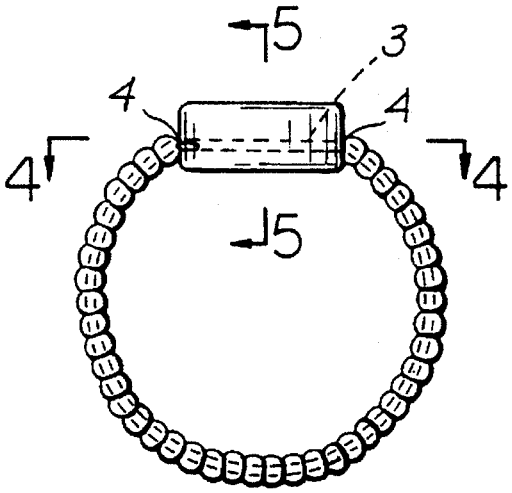
FIG. 2 is a front view of the invention.
Figure 3:
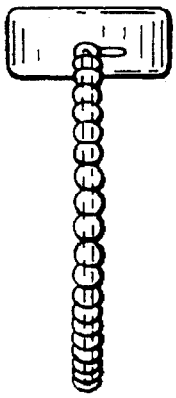
FIG. 3 is a side view of the present invention.
Figure 4:
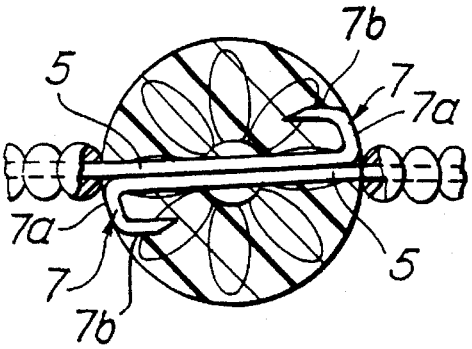
FIG. 4 is a sectional view taken along the lines of 4—4 in FIG. 2.
Figure 5:
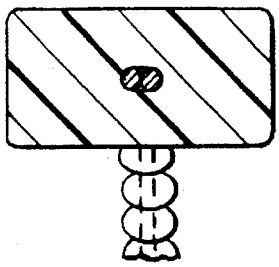
FIG. 5 is a sectional view taken along the lines of 5—5 of FIG. 2.
Figure 6:
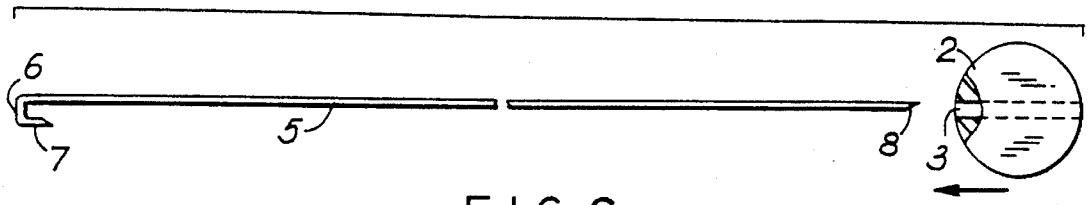
FIG. 6 is a view illustrating the method of making the ring in which a wire has one shaped in a clamp or closure and the other end is the lead end of the wire to be threaded through the hole going through the ring head.
Figure 7:
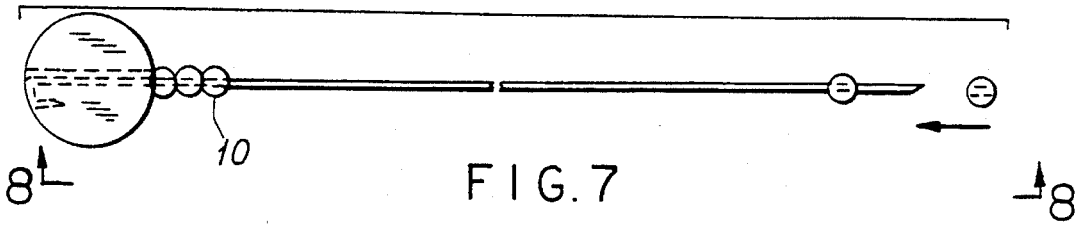
FIG. 7 shows the next step in the process in which the lead end of the wire is threaded through the ring head and the trailing end of the wire is formed as a catch and is at least partially embedded in the ring head and beads are being threaded onto the wire.
Figure 8:
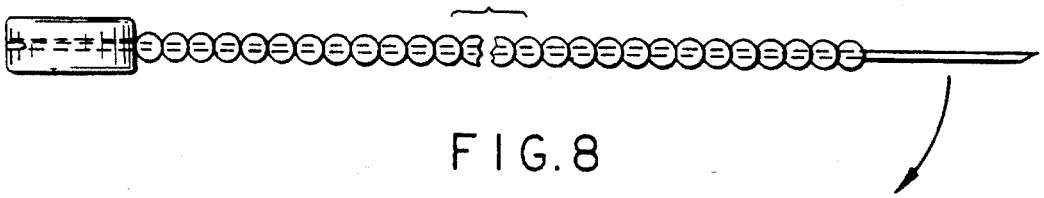
FIG. 8 shows the next step in the process in which all the beads have been placed onto the wire and FIG. 68 also shows the view of FIG. 7 along lines 8—8 with beads all added on to the wire.
Figure 9:
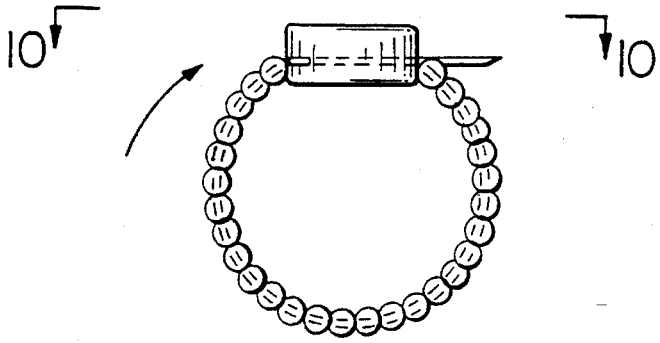
FIG. 9 shows the next step in the prices in which them wire is now threaded a second time through the hole in the ring head.
Figure 10:
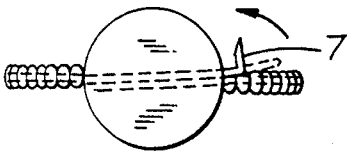
FIG. 10 the view along lines 10—10 of FIG. 9 with lead end of the wire being bent into a catch as had been previously done to the trailing end of the wire.
Figure 11:
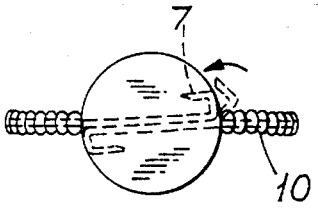
FIG. 11 shows the lead end of the wire bent into a catch shape being at least partially embedded into the ring head.
Figure 6A:
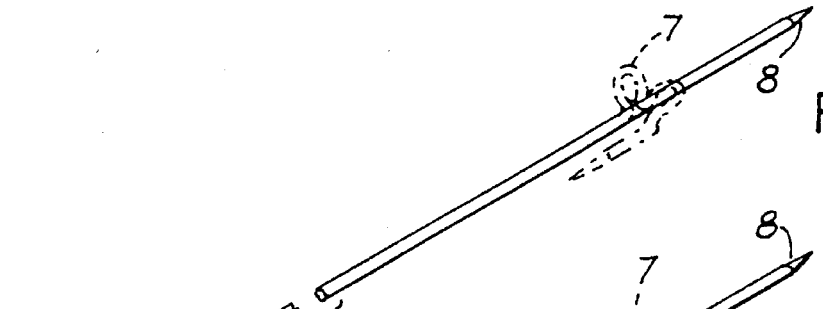
FIGS. 6A–6C show different embodiments for FIG. 6 in which instead of a U-shaped catch end for the wire may have any other possible shape.
Figure 6B:
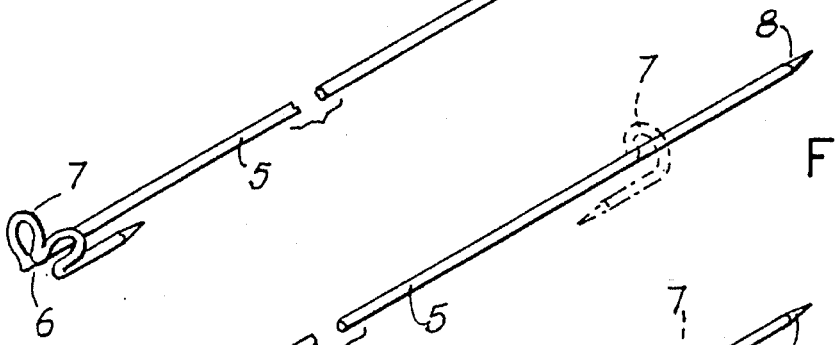
Figure 6C:
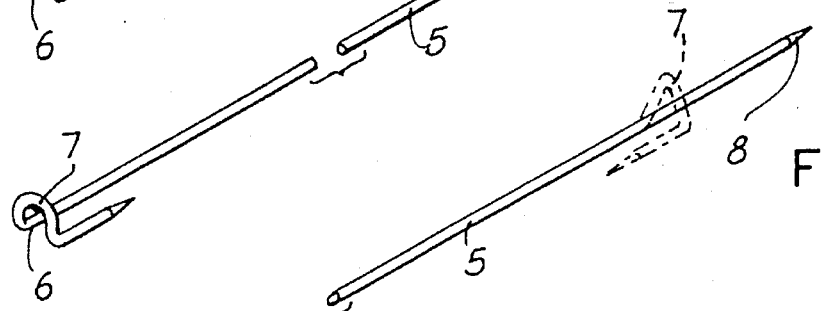
Figure 10A:
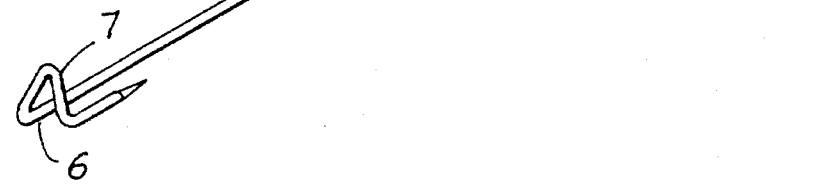
Figure 10A:
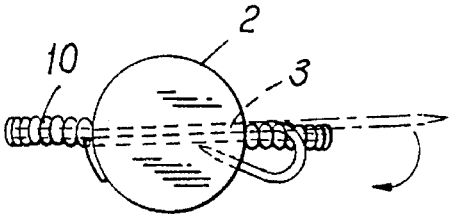
Figure 12:
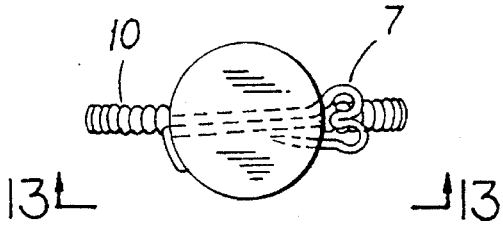
FIG. 12 shows another shaped catch of the lead end of the wire at least partially embedded into the ring head.
Figure 13:
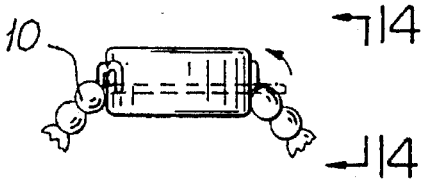
FIG. 13 is a view taken along lines 13—13 of FIG. 12.
Figure 14:
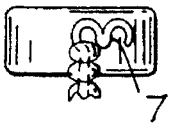
FIG. 14 is a view taken along lines 14—14 of FIG. 13.

Various designs can be fabricated utilizing such material which would appear on each face of the ring head. Techniques known for fabricating such designs include the Millifiore technique. This technique combines different colored clays to form designs which appear on both faces of the ring head. The material for the ring head 2 is malleable and elastic. A small drill hole 3 is drilled through the sides 4 of the ring head 2 as shown in FIG. 2. A wire or strand of material 5 is threaded through the hole 3. The trailing end 6 of the strand 5 is bent into a catch 7 and then at least partially embedded into a side 4 of the ring head 2. The strand or wire may be made of copper material. The catch 7 includes a portion **7*a* engaging and a portion 7*b* embedding the side surface of the ring can be shaped in any way possible. The invention is not limited to any particular shape. For example in FIG. 6 the catch 7 has a square u shape. FIGS. 6A through 6C show other possible shapes for the catch 7 such as a double loop shape (FIG. 6A); a u shape (FIG. 6B) and a triangular shape (FIG. 6C**).

The lead end 8 of the strand 5 is then threaded through openings 9 in beads 10. The beads 10 can be made of any preferable material such as glass, plastic or clay. The beads 10 are preferably selected with colors that are coordinated with the design of the ring head 2.

The lead end 8 of the strand 5 is then pulled through the drill hole 3 of the ring head 2 a second time and the end of the lead end 8 is shaped as a catch 7 and at least partially embedded into the ring head 2. The ring 1 is formed in this manner and constitutes the strand 5, the ring head 2 and the beads 10.

The strand 5 is preferably rigid and the beads 10 are stacked close together so that the bead at each end of the strand is pressed against the catches embedded in the sides of the ring head 2. Thus the beads are be preferably aligned in tight compressed order on the strand to apply pressure to the catches 7 that are embedded, at least partially into the ring head 2 to assist in keeping the strand ends connectably inserted within the ring head 2.

The drill hole through the ring head is in the preferred range of 0.5 mm to 1.5 mm in diameter. The hole for the beads is of the same diameter range as for the hole through the ring head. The strand or wire can have a thickness of from 0.012 inches to 0.022 inches in thickness and preferably in the range of 0.016 inches to 0.020 inches in thickness.

The beads are preferably 5 mm. to 20 mm. in diameter. The ring head is preferably 7 mm. to 12 mm. in diameter. The ring can be worn on a finger or a toe and the length of the strand should be made sufficiently long to fit around the circumference of a wearer's finger or toe.

The invention is not limited to the use of one strand of material or wire, As one can also have two or more wire or strands threaded through the ring head. Also additional strands can be threaded through the beads in the manner described above.

While presently preferred embodiments have described for purposes of this disclosure, numerous changes in the arrangement of method steps and apparatus parts can be made by those skilled in the art. Such changes are encompassed within the spirit of this invention as defined by the appended claims.

I claim:

1. A ring comprising:

a ring head formed of malleable material having a side surface, and having a hole extending through the side surface;

at least one strand of material threaded through said hole in said ring head; and catches formed at the ends of said strand which include a portion engaging the side surface of the ring head and a portion embedded into the side surface of the ring head at a distance spaced from said hole in said ring head so as to prohibit said catches from being pulled through said hole.

2. The ring according to claim 1 wherein said ring head is formed of elastic material.

3. The ring head according to claim 1 wherein said ring head is formed of polyvinylchloride material.

4. The ring according to claim 1 wherein said strand of material is threaded through said ring head at least twice.

5. The ring according to claim 1 wherein said ring includes beads which are threaded onto said strand of material.

6. The ring according to claim 5 wherein said beads are made of plastic material.

7. The ring according to claim 5 wherein said beads are made of glass.

8. The ring according to claim 5 wherein said beads are made of clay material.

9. The ring according to claim 5 wherein said hole through said ring head has a diameter of 0.5 to 1.5 millimeters.

10. The ring according to claim 1 wherein said strand of material is a wire.

11. The ring according to claim 1 wherein said ring head has a design on at least one face of said ring head.

12. The ring according to claim 1 wherein said ring head has two faces and has designs located on said two faces faces of said ring head.

13. The ring according to claim 12 wherein said beads are colored and said colors are coordinated with said designs of said ring head.

14. The ring according to claim 1 wherein said catches have square u shapes.

15. The ring according to claim 1 wherein said catches have double looped shapes.

16. The ring according to claim 1 wherein said catches have triangular shapes.

17. The ring according to claim 1 wherein said ring head has a width of 7 millimeters to 12 millimeters.

18. The ring according to claim 1 wherein said strand has a thickness of 0.12 inches to 0.022 inches.

19. The ring according to claim 1 wherein said strand has a thickness of 0.016 inches to 0.020 inches.

20. The ring according to claim 1 wherein said strand is made copper material.

* * * * *